United States Patent [19]

Lord et al.

[11] Patent Number: 4,887,670

[45] Date of Patent: Dec. 19, 1989

[54] CONTROLLING FRACTURE GROWTH

[75] Inventors: David L. Lord, Marlow; Buddy W. McDaniel; Lawrence E. Harris, both of Duncan, all of Okla.; J. E. Manrique, Bradford, Pa.

[73] Assignee: Halliburton Company, Duncan, Okla.

[21] Appl. No.: 333,515

[22] Filed: Apr. 5, 1989

[51] Int. Cl.[4] ..... E21B 43/267

[52] U.S. Cl. ..... 166/281; 166/280; 166/308

[58] Field of Search ..... 166/280, 281, 283, 292, 166/295, 308

[56] References Cited

U.S. PATENT DOCUMENTS

| | | | |
|---|---|---|---|
| 3,127,937 | 4/1964 | McGuire, Jr. et al. | 166/280 |
| 3,155,159 | 11/1964 | McGuire, Jr. et al. | 166/280 |
| 3,198,253 | 8/1965 | Holbert | 166/281 |
| 3,241,613 | 3/1966 | Kern et al. | 166/280 |
| 3,335,797 | 8/1967 | Braunlich, Jr. . | |
| 3,918,524 | 11/1975 | Broaddus et al. | 166/307 |
| 3,954,142 | 5/1976 | Broaddus et al. | 166/307 |
| 4,078,609 | 3/1978 | Pavlich | 166/280 X |
| 4,186,802 | 2/1980 | Perlman | 166/280 |
| 4,436,156 | 3/1984 | Fredrickson | 166/307 |
| 4,478,282 | 10/1984 | Nolte et al. | 166/281 |
| 4,509,598 | 4/1985 | Earl et al. | 166/308 |
| 4,515,214 | 5/1985 | Fitch et al. | 166/250 |

OTHER PUBLICATIONS

SPE 13797, "The Use of Density Control Foam Fracturing for Selective Proppant Placement in the Bartlesville Formation," Barber et al., 1985.

SPE 16433, "Mechanisms Controlling Fracture Height Growth in Layered Media," BenNaceur et al., 1987.

SPE 12152, "Fluid-Loss Control in the Naturally Fractured Buda Formation," Hall et al., 1983.

*Primary Examiner*—George A. Suchfield

*Attorney, Agent, or Firm*—Robert A. Kent; Clark Dougherty

[57] ABSTRACT

The present invention provides methods of controlling the growth of one or more vertically oriented fractures in a subterranean formation during a fracturing treatment. A first fluid having a known density and containing a diverting agent is introduced into a formation to create a fracture. A second fluid which may contain proppant and having a known density different from the first fluid then is introduced into the fracture whereby the second fluid selectively overrides or underrides the first fluid. Such fluid control forces the first fluid to the bottom or top of the fracture whereby the diverting agent therein is caused to screen out and impede further downward or upward growth of the fracture. The introduction of the second fluid then can be continued to extend the fracture as desired.

20 Claims, 3 Drawing Sheets

CONTROLLING FRACTURE GROWTH

BACKGROUND OF THE INVENTION

1. Field of the Invention

The present invention relates to methods of controlling fracture growth during a fracturing treatment through the use of diverting agents and fluid density control.

2. Description of the Prior Art

A variety of techniques have heretofore been developed and used for stimulating the production of oil and gas from subterranean formations penetrated by well bores. One commonly used such technique for stimulating producing formations formed of relatively low permeability materials is comprised of pumping a fracturing fluid at a pressure and rate into the formation whereby one or more fractures are hydraulically created therein. The fractures are extended by continued pumping, and a propping agent such as sand transported by the fracturing fluid is deposited in the fractures. The propping agent functions to maintain the fractures open after the hydraulic pressure on the formation is withdrawn.

Another commonly used production stimulation technique is known in the art as fracture acidizing. Fracture acidizing consists of creating and extending one or more fractures followed by etching the fracture faces with acid so that when hydraulic pressure on the formation is withdrawn, flow channels remain therein through which desired fluids contained in the formation flow to the well bore.

While most wells are completed in the zone of best possible oil and/or gas production, it has heretofore been difficult to prevent a created fracture or fractures from extending vertically above and/or below the desired zone, often resulting in the fractures extending into less desirable zones in the formation or into adjacent formations. For example, zones producing excessive water often lie in close proximity to preferred production zones. When fracture treatments are carried out to stimulate the production of oil and/or gas from the preferred zones, flow channels extending into water producing zones can be simultaneously created resulting in the production of undesirable water along with desired oil and/or gas.

A number of techniques have been proposed for controlling the growth of fractures which have met with varying degrees of success. For example, U.S. Pat. No. 3,335,797 issued Aug. 15, 1967 discloses a method of controlling the direction of fractures created during hydraulic fracturing wherein propping agent is caused to be placed at the bottom of the fractures to inhibit subsequent downward fracturing during the extension of the fractures. U.S. Pat. No. 3,954,142 issued May 4, 1976 is directed to methods of confining a subterranean formation treatment such as an acidizing treatment to a desired zone within the formation by controlling the density of the various fluids involved. U.S. Pat. No. 4,509,598 issued Apr. 9, 1985 is directed to a method of limiting the upward growth of vertical fractures during a hydraulic fracturing treatment by including buoyant inorganic diverting agent in the fracturing fluid.

U.S. Pat. No. 4,515,214 issued May 7, 1985 is directed to a method of controlling the vertical growth of hydraulic fractures wherein the fracture gradients of the formation to be fractured and adjacent formations are first determined. Based on the fracture gradients, the density of fracturing fluid necessary to inhibit fracture propagation from the formation to be fractured into adjacent formations is determined, and a fracturing fluid of such density is used to fracture the formation. U.S. Pat. No. 4,478,282 issued Oct. 23, 1984 is directed to a technique for controlling vertical height growth of fractures wherein a flow block material is utilized which forms a barrier to fluid flow into the vertical extremities of the fractures.

By the present invention improved methods of controlling the growth of one or more vertically oriented fractures in a subterranean formation during a fracturing treatment are provided whereby growth in either or both the upward and downward directions is impeded during outward fracture extension.

SUMMARY OF THE INVENTION

Methods of controlling the growth of one or more vertically oriented fractures in a subterranean formation during a fracturing treatment performed therein are provided. In one aspect, a method is provided for reducing the upward or downward growth of one or more fractures while the fractures are being extended outwardly from the well bore comprising introducing a first fracturing fluid containing a diverting agent and having a known density into the fractures. A second fracturing fluid which may or may not contain propping agent having a known density different from the density of the first fracturing fluid is then introduced into the fractures whereby the second fracturing fluid selectively overrides or underrides the first fracturing fluid. Such overriding or underriding of the first fracturing fluid which contains diverting agent forces the first fracturing fluid to the bottoms or tops of the fractures whereby the diverting agent contained therein is caused to screen out along the bottoms or tops of the fractures and to thereby impede further downward or upward growth of the fractures. The introduction of the second fracturing fluid into the fractures is continued until the fractures are extended a desired amount.

In another aspect of the present invention a method of limiting both the upward and downward growth of one or more vertically oriented fractures in a subterranean formation during a fracturing treatment performed therein is provided. The method includes the introduction of a first fracturing fluid into the fractures having a known density and containing a diverting agent. A second fracturing fluid containing diverting agent and having a known density either lower or higher than the density of the first fracturing fluid is next introduced into the fractures whereby the second fracturing fluid overrides or underrides the first fracturing fluid. A third fracturing fluid which may or may not contain propping agent is then introduced into the fractures having a known density between the densities of the first and second fracturing fluids whereby the third fracturing fluid is substantially confined between the first and second fracturing fluids and forces the first and second fracturing fluids to the bottoms and tops of the fractures. The diverting agent in the first and second fracturing fluids is caused to screen out at the bottoms and tops of the fractures and to thereby impede the downward and upward growth of the fractures while the fractures are being extended outwardly by the continued introduction of the third fracturing fluid.

In preferred embodiments of the methods described, spacer fluids containing additives for providing fracturing fluid compatibility with the formation being fractured and for establishing flow patterns over or under the fracturing fluids involved are also introduced into the fractures.

It is, therefore, an object of the present invention to provide improved methods of controlling the growth of one or more vertically oriented fractures in a subterranean formation during a fracturing treatment carried out therein.

Other and further objects, features and advantages of the present invention will be readily apparent to those skilled in the art upon a reading of the description of preferred embodiments which follows when taken in conjunction with the accompanying drawings.

DESCRIPTION OF THE PREFERRED EMBODIMENTS

Figure 1:
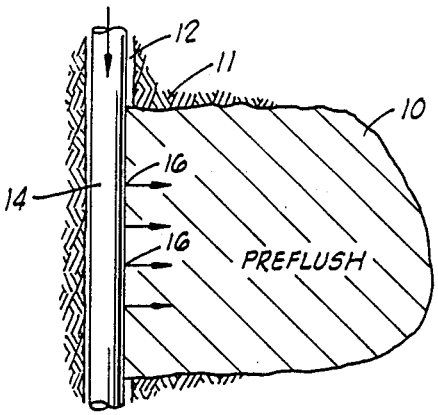
FIG. 1 is a schematic illustration of a fracture in a subterranean formation after a preflush fluid has been introduced therein.

In performing hydrocarbon production stimulation treatments in subterranean formations penetrated by well bores, particularly those formed of relatively impermeable and fracturable materials, it has become common practice to hydraulically induce fractures in the most desirable zones of such formations and extend the fractures outwardly from the well bores. Propping agent, e.g., sand, is distributed into the fractures as they are extended whereby upon the withdrawal of hydraulic pressure from the formations, the fractures are propped open and hydrocarbon fluids contained in the formations more freely flow therefrom to the well bores. In most formations, the hydraulically induced fractures are vertically oriented, i.e., the faces of the fractures lie in substantially vertical planes.

The hydraulic fracturing of a subterranean formation is accomplished by pumping a fracturing fluid through the well bore into the formation to be fractured at a rate and pressure such that the hydraulic force exerted on the formation causes the parting or fracturing of the formation. The hydraulic force is usually caused to be exerted on the formation at a location adjacent the most productive and desired zone thereof by way of perforations formed in the well bore casing and the formation. Once fractures have been formed in the zone, continued pumping of the fracturing fluid into the fractures extends the fractures. While it is desirable that the fractures be extended outwardly from the well bore through the productive zone of the formation, it is often undesirable to extend the fractures upwardly and/or downwardly. Unfortunately, continued application of hydraulic force within vertically oriented fractures often causes the fractures to extend upwardly and downwardly as well as outwardly from the well bore. If undesirable zones lie above or below the desired productive zone, and if during the fracture treatment fractures are extended into the adjacent undesirable zones, fluids therefrom are produced along with fluids from the desired zone into the well bore. For example, zones containing excessive water can lie adjacent oil and/or gas producing zones, and stimulation of the production of such water with the oil and/or gas is a highly undesirable result. In other situations, the upward and/or downward growth of fractures into poorly producing or nonproducing strata above and/or below the productive zone can reduce the stimulation effectiveness of the fracturing treatment.

The present invention provides methods of controlling the upward, downward, or both the upward and downward growth of one or more vertically oriented fractures in a subterranean formation during the performance of a fracturing treatment therein. If downward fracture growth is undesirable, a method of the present invention can be utilized to impede the growth of fractures downwardly while allowing outward and upward fracture growth to occur. Conversely, if upward fracture growth is undesirable, a method can be utilized to impede upward growth while allowing outward and downward growth. If the productive zone is sandwiched between undesirable zones or if both upward and downward fracture growth is otherwise undesirable, a method of this invention can be utilized to impede both upward and downward growth while the fractures are extended outwardly within the productive zone.

Referring now to FIGS. 1–5, the method of the present invention for controlling the downward growth of one or more vertically oriented fractures is illustrated schematically. As shown in FIG. 1, a vertically oriented fracture 10 in a subterranean formation 11 extends outwardly from a well bore 12 penetrating the formation 11. A casing or liner 14 is positioned in the well bore 12 having perforations 16 disposed therein. The perforations 16 are positioned adjacent and into a desirable production zone of the formation 11. The formation 11 is broken down and the fracture 10 is initially hydraulically induced by the injection of a high density, usually low viscosity preflush fluid (often referred to as a prepad) into the formation. That is, a preflush fluid such as water containing the usual additives, e.g., friction reducing and fluid loss control agents is pumped into the formation 11 by way of the perforations 16 at a rate and pressure such that at least one fracture 10 is hydraulically induced in the formation 11.

Figure 2:
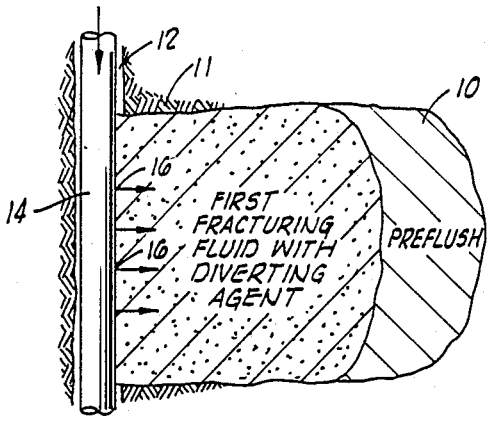
FIG. 2 is a schematic illustration of the fracture of FIG. 1 after a first fracturing fluid with diverting agent has been introduced therein.

As shown in FIG. 2, after injection of the preflush fluid, a first fracturing fluid (often referred to as a pad) having a high density, a moderate to high viscosity and having diverting agent suspended therein is injected into the fracture. A large volume of the first fracturing fluid, typically about 5% to 50% of the total volume of all of the fluids injected, is usually introduced into the fracture 10. The preflush and the first fracturing fluid can contain weighting agents to increase their density such as calcium chloride and sodium chloride salts. Moderate to high viscosity can be imparted to the first fracturing fluid by viscosity increasing agents, e.g., guar and guar derivatives such as hydroxypropylguar, cellulose derivatives such as hydroxyethylcellulose, synthetic polymers such as polyacrylamide, and other polymers, all of which may or may not be crosslinked. The diverting agent suspended in the first fracturing fluid can be any of a variety of particulate material which will function to divert a fracturing fluid and impede the growth of a fracture when deposited therein. Preferred diverting agents for use in accordance with this invention are those selected from the group consisting of sand, silica flour, oil-soluble resins and mixtures of such diverting agents. The most preferred diverting agent for use in impeding the downward growth of fractures is a mixture of about 70–170 U.S. mesh sand and silica flour of about 200 U.S. mesh or smaller.

Figure 3:
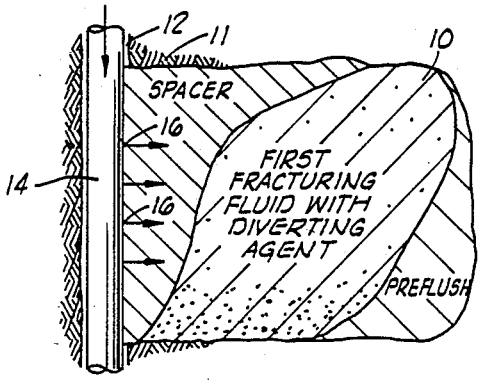
FIG. 3 is a schematic illustration of the fracture of FIG. 1 after a spacer fluid has been introduced therein.

Referring to FIG. 3, a low viscosity spacer fluid having a density lower than the density of the first fracturing fluid and preflush fluid is next injected into the fracture 10. The lower density of the spacer fluid causes it to override the first fracturing and preflush fluids as illustrated in FIG. 3. The spacer fluid preferably includes the usual surfactants and other chemicals for providing compatibility with the formation, e.g., de-emulsifiers, wetting agents, clay-control additives, and the like. The spacer fluid serves to establish a flow pattern across the top of the more dense fluids beneath it, and a volume of about 10% of the total fluids injected is used, preferably not less than about 1600 gallons.

Figure 4:
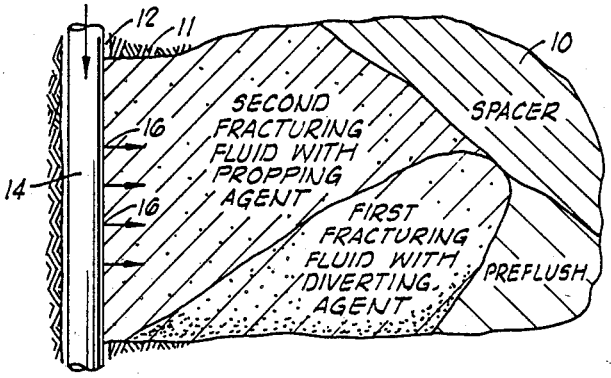
FIG. 4 is a schematic illustration of the fracture of FIG. 1 after a second fracturing fluid with propping agent has been introduced therein.

Referring to FIG. 4, a second fracturing fluid having a low density, a high viscosity and containing propping agent suspended therein is injected into the fracture 10. The low density of the second fracturing fluid causes it to override the first fracturing fluid as shown. The propping agent suspended in the second fracturing fluid can be selected from sand, resin coated sand, manufactured ceramics, resin coated ceramics and mixtures of such propping agents. The propping agent is maintained in suspension in the second fracturing fluid as a result of high viscosity imparted to it by viscosity increasing agents of the type described above. As will be understood by those skilled in the art, when the methods of this invention are utilized to carry out fracture acidizing treatments or other fracturing treatments where propping agent is not required, the second fracturing fluid will not contain propping agent.

Generally, the second fracturing fluid should have a density at least 0.5 pounds per gallon less than the density of the first fracturing fluid. When needed to provide the required low density, the second fracturing fluid can be emulsified, commingled with a gas such as nitrogen or carbon dioxide, or foamed therewith. The continued introduction of the second fracturing fluid forces the first fracturing fluid downwardly to the bottom of the fracture 10 whereby the diverting agent suspended in the first fracturing fluid is caused to screen out along the bottom. The presence of the diverting agent in the bottom of the fracture 10 causes the downward growth of the fracture 10 to be impeded as the second fracturing fluid containing propping agent is continued to be introduced and the fracture 10 extended.

Figure 5:
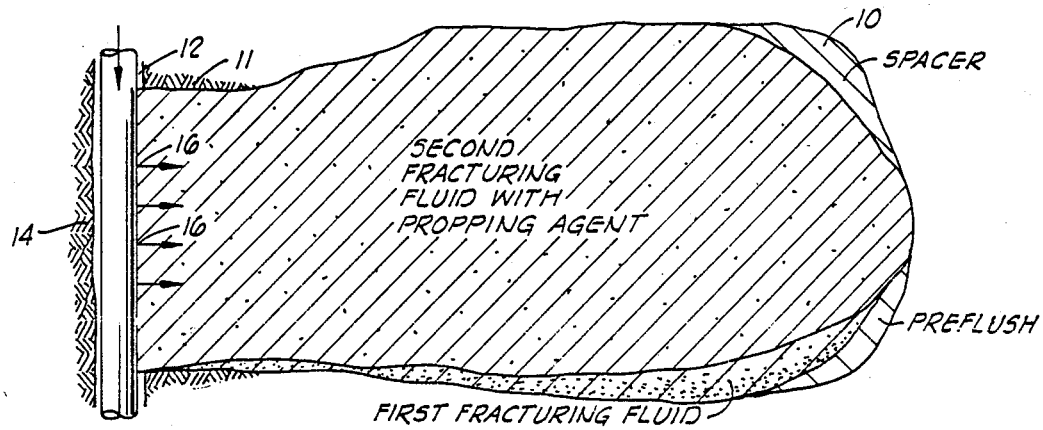
FIG. 5 is a schematic illustration of the fracture of FIG. 1 after the introduction of the second fracturing fluid with propping agent has been continued to extend the fracture.

As shown in FIG. 5, upon completing the introduction of the second fracturing fluid, the fracture 10 is extended in the formation in directions outwardly and upwardly but not appreciably downwardly. Once the fracture 10 has been extended and propping agent transported therein, the hydraulic pressure exerted on the formation is relieved by cessation of pumping and by fluid leak-off into the formation porosity and/or fluid flow-back, which causes the fracture 10 to close on the propping agent, if present, whereby the fracture is maintained in an open conductive position.

Figure 6:
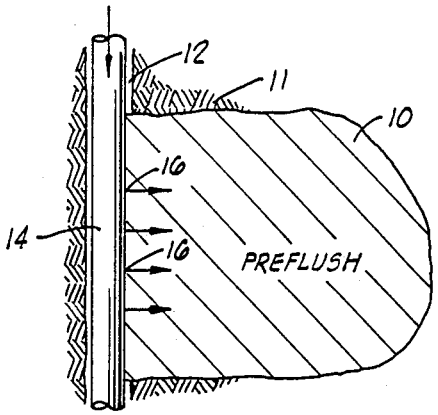
FIG. 6 is a schematic illustration of a subterranean formation after a preflush fluid has been introduced therein.

Referring now to FIGS. 6–10, the method of the present invention for limiting the upward growth of one or more vertically oriented fractures 10 in the subterranean formation 11 during a fracturing treatment therein is illustrated. As shown in FIG. 6, a preflush fluid is first injected into the formation 11 to break down the formation 11 and initially induce the fracture 10. The preflush fluid preferably has a low density as well as a low viscosity.

Figure 7:
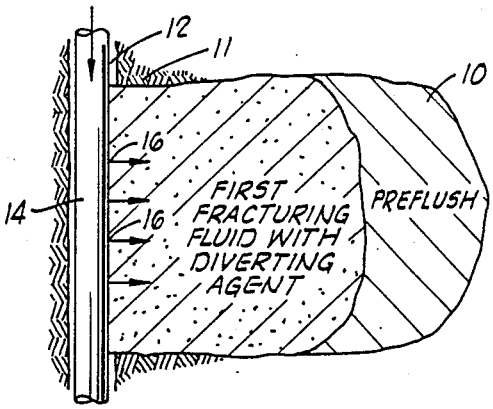
FIG. 7 is a schematic illustration of the fracture of FIG. 6 after a first fracturing fluid with diverting agent has been introduced therein.

As shown in FIG. 7, a first fracturing fluid having a low density, a high viscosity and containing diverting agent is next introduced into the fracture 10. A particularly suitable such diverting agent for this use is a mixture of oil-soluble resin and silica flour. The viscosity of the first fracturing fluid must be high so that the diverting agent is suspended therein, and viscosity increasing agents of the type described above are included for this purpose.

Figure 8:
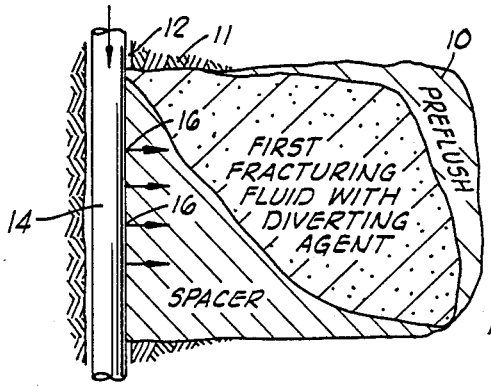
FIG. 8 s a schematic illustration of the fracture of FIG. 6 after a spacer fluid has been introduced therein.

As shown in FIG. 8, a low viscosity spacer fluid having a density higher than the preflush fluid and first fracturing fluid is next injected into the fracture. The spacer fluid again preferably contains additives to ensure compatibility with the formation, and because of its higher density, the spacer fluid underrides the lighter first fracturing fluid containing diverting agent. The spacer fluid functions in the same manner as described above, and its volume should be about 10% of the total volume of fluids injected, but not less than about 1600 gallons.

Figure 9:
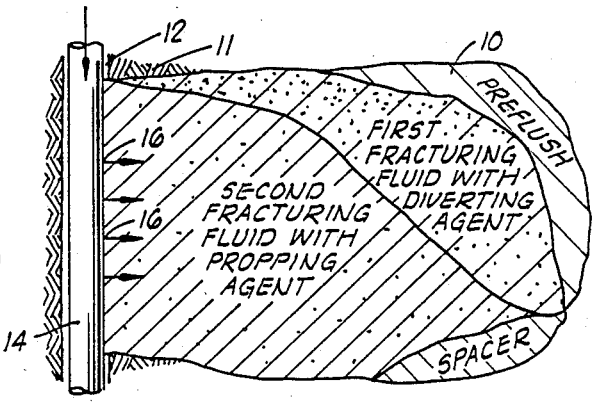
FIG. 9 is a schematic illustration of the fracture of FIG. 6 after a second fracturing fluid with propping agent has been introduced therein.

As shown in FIG. 9, after the injection of the spacer fluid, a second fracturing fluid having a high density and containing propping agent or not containing propping agent depending upon the type of fracturing treatment being performed is injected into the fracture 10.

The viscosity of the second fracturing fluid can vary so long as the second fracturing fluid can transport the proppant, if present, into the fracture 10 as it is extended.

Figure 10:
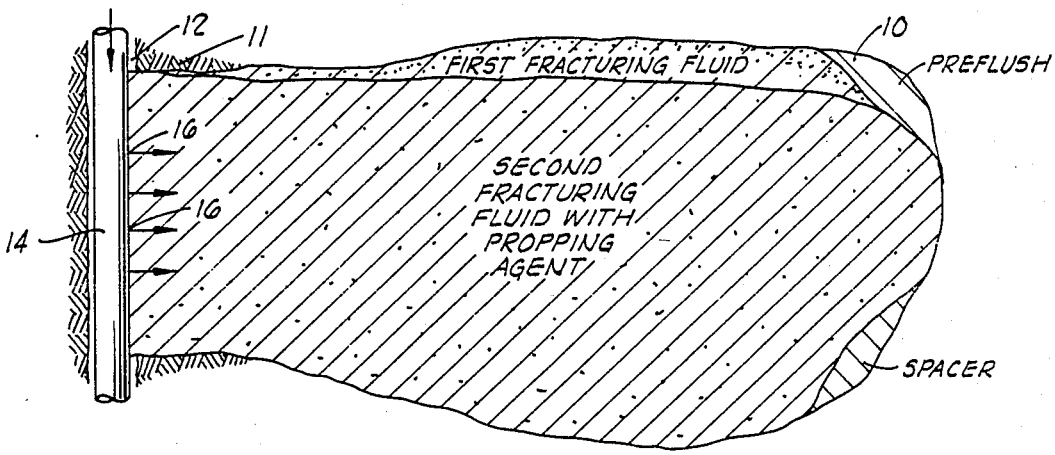
FIG. 10 is a schematic illustration of the fracture of FIG. 6 after the introduction of the second fracturing fluid with propping agent has been continued to extend the fracture.

As shown in FIG. 10, the continued injection of the second fracturing fluid forces the first fracturing fluid and diverting agent contained therein upwardly to the top of the fracture 10 whereby the diverting agent is caused to screen out along the top of the fracture 10 and thereby impede its upward growth. Thus, at the completion of the fracturing treatment, the fracture 10 has been extended outwardly and downwardly but not substantially upwardly.

Figure 11:
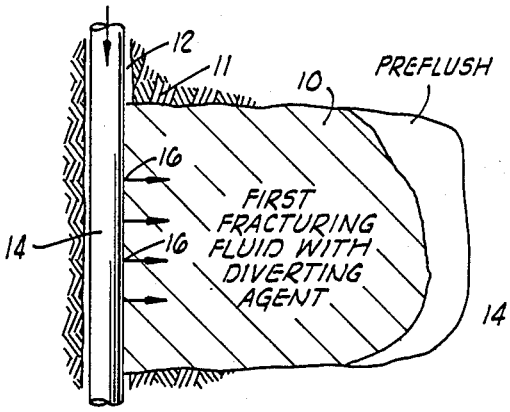
FIG. 11 is a schematic illustration of a subterranean formation after a preflush fluid and a first fracturing fluid with diverting agent have been introduced therein.

Referring now to FIGS. 11–16, the method of the present invention for controlling the growth of one or more vertically oriented fractures 10 in the subterranean formation 11 in both the upward and downward directions during a fracturing treatment is illustrated. As shown in FIG. 11, the formation 11 is broken down and a fracture 10 initiated therein by the injection of a high density, generally low viscosity preflush fluid. The preflush is followed by a first fracturing fluid having a high density, a moderate to high viscosity and containing diverting agent.

Figure 12:
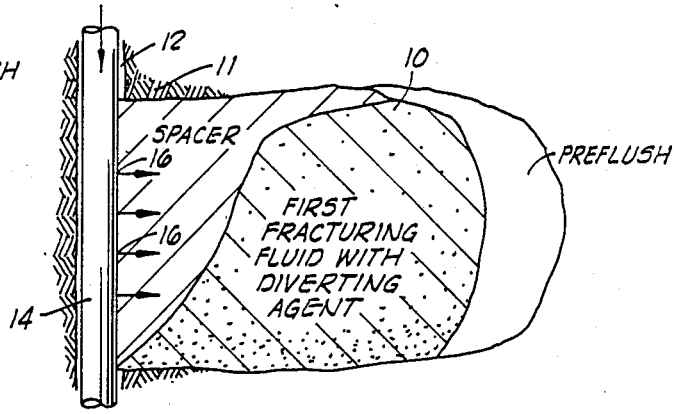
FIG. 12 is a schematic illustration of the fracture of FIG. 11 after a spacer fluid has been introduced therein.

As shown in FIG. 12, a low viscosity spacer fluid having a density lower than the preflush fluid and first fracturing fluid is next injected into the fracture 10. The volume of the spacer is again about 10% of the total treatment fluid volume, but not less than about 1600 gallons, and the spacer fluid contains additives to provide compatibility with the formation. Because of the lower density of the spacer fluid it overrides the preflush fluid and first fracturing fluid.

Figure 13:
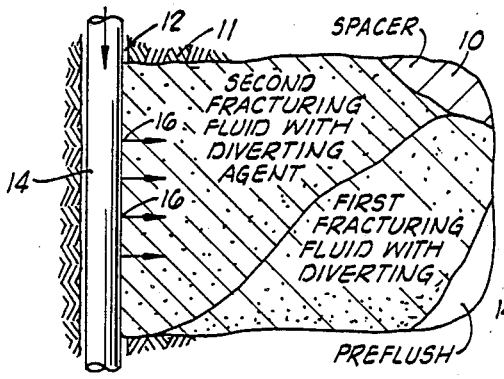
FIG. 13 is a schematic illustration of the fracture of FIG. 11 after a second fracturing fluid with diverting agent has been introduced therein.

As shown in FIG. 13, a second fracturing fluid having a low density, a moderate to high viscosity and containing additional diverting agent is next introduced into the fracture. Because of its low density, the second fracturing fluid overrides the first fracturing fluid.

Figure 14:
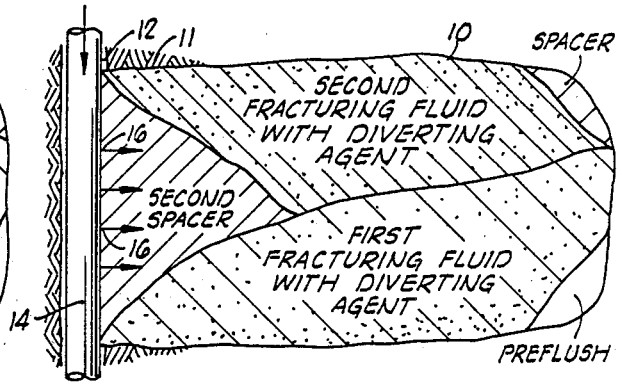
FIG. 14 is a schematic illustration of the fracture of FIG. 11 after a second spacer fluid has been introduced therein.

The second fracturing fluid is followed by a second spacer fluid as shown in FIG. 14 which has a density between the densities of the first and second fracturing fluids so that it follows a path between the two fluids.

Figure 15:
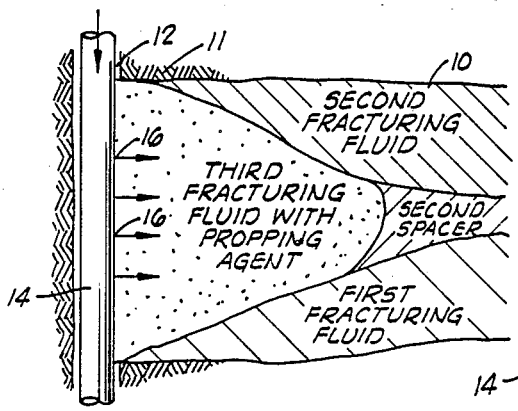
FIG. 15 is a schematic illustration of the fracture of FIG. 11 after a third fracturing fluid with propping agent has been introduced therein.

As shown in FIG. 15, a third fracturing fluid having a density between the densities of the first and second fracturing fluids is introduced into the fracture 10. The third fracturing fluid can contain propping agent depending on the type of fracturing treatment being performed and has a viscosity sufficient to maintain propping agent, if present, in suspension.

Figure 16:
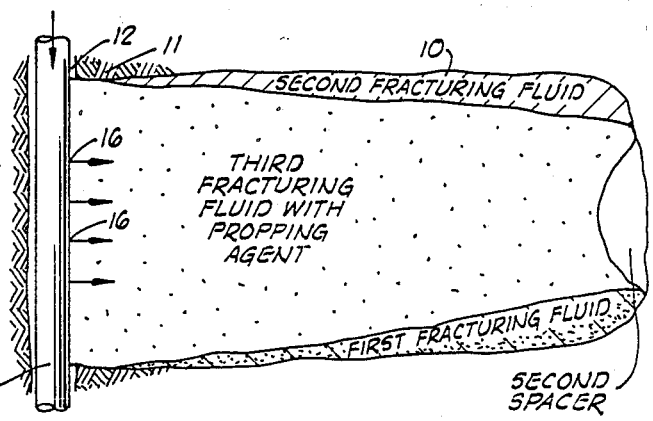
FIG. 16 is a schematic illustration of the fracture of FIG. 11 after the introduction of the third fracturing fluid with propping agent has been continued to extend the fracture.

As shown in FIG. 16, the continued introduction of the third fracturing fluid into the fracture 10 forces the first and second fracturing fluids containing diverting agent to the bottom and top of the fracture 10, respectively, whereby the diverting agent screens out along the bottom and top of the fracture 10 and impedes the growth of the fracture 10 in downward and upward directions. The continued pumping of the third fracturing fluid thus extends the fracture 10 in an outward direction from the well bore 12 without appreciably extending the fracture 10 in downward or upward directions.

As mentioned above, in order for one fracturing fluid to override, underride or pass between other fracturing fluids, the difference in density between the fracturing fluids should be at least about 0.5 pounds per gallon. In order to provide such density difference, various types of fluids can be utilized. For example, the fluids having high density can be water-based fluids, aqueous salt solutions, brines and the like. Fluids having intermediate densities can be hydrocarbon-based fluids, oil-in-water emulsions and the like. Fracturing fluids having low densities can be water or oil-based commingled mixtures or foams formed with nitrogen or carbon dioxide. Also, in carrying out the method of the present invention where both the upward and downward growth of fractures are controlled, the second fracturing fluid density can be either lower or higher than the first fracturing fluid density so long as the second fracturing either overrides or underrides the first fracturing fluid.

In order to illustrate the methods of the present invention the following example is given.

EXAMPLE

A well in the Medina formation was fractured at a depth of 2,197 feet using a method of the present invention. The production zone was a gas producing interval, bounded above by a sandy shale formation which experience has shown to fracture preferentially to the producing interval. In order to prevent fractures from extending into this upper zone, the below described treatment was used and fracture growth in the upward direction was impeded.

Treated water was initially injected to break down the formation and induce one or more fractures therein. After breakdown, pumping increased and a surface pressure was measured. 12 bbls. of a preflush fluid comprised of 50% quality foam having a density of 4.72 lb./gal. and a low viscosity were then injected into the fracture at a rate of 3 bbls./min. and at a surface pressure of about 1000 psig.

Forty-eight (48) bbls. of a low density, high viscosity first fracturing fluid containing diverting agent were next injected into the fractures at a rate of 5 bbls./min. and a surface pressure of about 1000 psig. The first fracturing fluid was 75% quality foam having a density of 4.13 lb./gal. gelled with 20 lbs. per 1000 gal. of hydroxypropylguar gelling agent to yield a high viscosity. The diverting agent was 1.5 lb./gal. of a 50:50 mixture of 70–170 mesh sand and silica flour suspended in the first fracturing fluid.

Thirty-eight (38) bbls. of an ungelled water spacer fluid containing 120 scf $N_2$ per bbl. were injected into the fractures after the first fracturing fluid at a rate of 3 bbls./min. and at a surface pressure of 1000 psig. The spacer fluid had a density of 7.20 lb./gal. and contained 2% KCl and surfactants for providing compatibility with the formation. Because of the higher density of the spacer fluid, it flowed under the first fracturing fluid and provided a flow pattern thereacross.

Finally, 120 bbls. of a high density, moderate viscosity second fracturing fluid containing propping agent were injected into the fractures at a rate of 13 bbls./min. and a surface pressure of about 1000 psig. The second fracturing fluid was gelled water commingled with 120 scf $N_2$ per bbl. having a density of 7.53 to 8.44 lb./gal. gelled with 20 lbs. per 1000 gal. of hydroxypropylguar gelling agent. The propping agent was 45,250 lbs. of 20/40 mesh sand suspended in the second fracturing fluid.

As the second fracturing fluid was injected, it flowed under the first fracturing fluid and the first fracturing fluid was forced to the tops of the fractures whereby the diverting agent screened out along the tops of the fractures. This, in turn, impeded the upward growth of the fractures as they were extended outwardly.

The production from the treated zone was stimulated by the fracturing treatment, and the fractures created did not extend into the zone lying above the production zone.

Thus, the present invention is well adapted to carry out the objects and attain the ends and advantages mentioned as well as those inherent therein. While numerous changes in the order of steps and the like may be made by those skilled in the art, such changes are encompassed within the spirit of this invention as defined by the appended claims.

What is claimed is:

1. A method of controlling the growth of one or more vertically oriented fractures in a subterranean formation during a fracturing treatment therein comprising:

introducing a first fracturing fluid into said formation and into at least one fracture formed therein, said first fracturing fluid having a known density and containing a diverting agent;

introducing a second fracturing fluid into said fracture having a known density different from density of said first fracturing fluid whereby said second fracturing fluid selectably the overrides or underrides said first fracturing fluid and forces said first fracturing fluid to the bottom or top of said fracture whereby said diverting agent contained therein is caused to screen out along the bottom or top of said fracture and to thereby impede further downward or upward growth of said fracture; and continuing the introduction of said second fracturing fluid into said fracture until said fracture is extended a desired amount.

2. The method of claim 1 wherein said first fracturing fluid is a high density fluid and said second fracturing fluid is a low density fluid whereby said second fracturing fluid overrides said first fracturing fluid.

3. The method of claim 1 wherein said first fracturing fluid is a low density fluid and said second fracturing fluid is a high density fluid whereby said second fracturing fluid underrides said first fracturing fluid.

4. The method of claim 1 which is further characterized to include the step of introducing a spacer fluid into said fracture after said first fracturing fluid and before said second fracturing fluid, said spacer fluid having a known density between the densities of said first and second fracturing fluids.

5. The method of claim 4 wherein said first and second fracturing fluids are more viscous than said spacer fluid.

6. The method of claim 5 wherein said diverting agent is selected from the group consisting of sand, silica flour, oil-soluble resins, and mixtures of such diverting agents.

7. A method of reducing the downward growth of one or more vertically oriented fractures in a subterranean formation during a fracturing treatment therein comprising:

introducing a first fracturing fluid into said formation and into at least one fracture therein, said first fracturing fluid having a known density and containing a diverting agent;

introducing a second fracturing fluid into said fracture having a density lower than said first fracturing fluid whereby said second fracturing fluid overrides said first fracturing fluid, forces said first fracturing fluid to the bottom of said fracture and causes said diverting agent to be placed along the bottom of said fracture thereby impeding the further downward growth of said fracture; and continuing the introduction of said second fracturing fluid into said fracture until said fracture is extended a desired amount.

8. The method of claim 7 which is further characterized to include the step of introducing a spacer fluid into said fracture after said first fracturing fluid and before said second fracturing fluid, said spacer fluid having a known density between the densities of said first and second fracturing fluids.

9. The method of claim 8 wherein said second fracturing fluid is more viscous than said spacer fluid.

10. The method of claim 9 wherein said diverting agent is selected from the group consisting of sand, silica flour, oil-soluble resins, and mixtures of such diverting agents.

11. A method of reducing the upward growth of one or more vertically oriented fractures in a subterranean formation during a fracturing treatment therein comprising:

introducing a first fracturing fluid into said formation and into at least one fracture therein, said first fracturing fluid having a known density and containing a diverting agent;

introducing a second fracturing fluid into said fracture having a density higher than said first fracturing fluid whereby said second fracturing fluid underrides said first fracturing fluid, forces said first fracturing fluid to the top of said fracture and causes said diverting agent to be screened out along the top of said fracture thereby impeding the further upward growth of said fracture; and continuing the introduction of said second fracturing fluid into said fracture until said fracture is extended a desired amount.

12. The method of claim 11 which is further characterized to include the step of introducing a spacer fluid into said fracture after said first fracturing fluid and before said second fracturing fluid, said spacer fluid having a known density between the densities of said first and second fracturing fluids.

13. The method of claim 12 wherein said first and second fracturing fluids are more viscous than said spacer fluid.

14. The method of claim 13 wherein said diverting agent is selected from the group consisting of sand, silica flour, oil-soluble resins, and mixtures of such diverting agents.

15. A method of controlling the growth of one or more vertically oriented fractures in a subterranean formation during a fracturing treatment therein comprising:

introducing a first fracturing fluid into said formation and into at least one fracture formed therein, said first fracturing fluid containing a diverting agent and having a known density;

introducing a second fracturing fluid into said fracture, said second fracturing fluid containing a diverting agent and having a known density lower or higher than the density of said first fracturing fluid whereby said second fracturing fluid overrides or underrides said first fracturing fluid;

introducing a third fracturing fluid into said fracture, said third fracturing fluid having a known density between the densities of said first and second fracturing fluids whereby said third fracturing fluid is substantially confined between said first and second fracturing fluids and forces said first and second fracturing fluid to the bottom and top of said fracture whereby the diverting agent therein is caused to screen out and thereby impede the downward and upward growth of said fracture; and continuing the introduction of said third fracturing fluid into said fracture until said fracture is extended outwardly a desired amount.

16. The method of claim 15 which is further characterized to include the step of introducing a first spacer fluid into said fracture after said first fracturing fluid and before said second fracturing fluid, said first spacer fluid having a known density between the densities of said first and second fracturing fluids.

17. The method of claim 16 which is further characterized to include the step of introducing a second spacer fluid into said fracture after said second fracturing fluid and before said third fracturing fluid, said second spacer fluid having a known density between the densities of said second and third fracturing fluids.

18. The method of claim 17 wherein said second fracturing fluid is more viscous than said first spacer fluid.

19. The method of claim 18 wherein said second and third fracturing fluids are more viscous than said second spacer fluid.

20. The method of claim 19 wherein said diverting agent is selected from the group consisting of sand, silica flour, oil-soluble resins, and mixtures of such diverting agents.

* * * * *